US009951771B2

(12) United States Patent
Snead et al.

(10) Patent No.: US 9,951,771 B2
(45) Date of Patent: Apr. 24, 2018

(54) SELECTABLE FLOW HYDRAULIC GEAR PUMP

(71) Applicant: DANFOSS POWER SOLUTIONS INC., Ames, IA (US)

(72) Inventors: Wallace K. Snead, Fairfield, IA (US); Thomas G. Modica, Kenosha, WI (US); Alfred J. Permann, Ankeny, IA (US)

(73) Assignee: Danfoss Power Solutions Inc., Ames, IA (US)

( * ) Notice: Subject to any disclaimer, the term of this patent is extended or adjusted under 35 U.S.C. 154(b) by 368 days.

(21) Appl. No.: 14/195,226

(22) Filed: Mar. 3, 2014

(65) Prior Publication Data

US 2014/0301882 A1 Oct. 9, 2014

Related U.S. Application Data

(60) Provisional application No. 61/809,663, filed on Apr. 8, 2013.

(51) Int. Cl.
*F04C 2/14* (2006.01)
*F04C 11/00* (2006.01)
(Continued)

(52) U.S. Cl.
CPC ..... *F04C 2/14* (2013.01); *F04C 11/001* (2013.01); *F04C 14/02* (2013.01); *F04C 14/24* (2013.01);
(Continued)

(58) Field of Classification Search
CPC .. F04C 2/14; F04C 14/02; F04C 14/24; F04C 14/26; F04C 11/01; F04C 15/06;
(Continued)

(56) References Cited

U.S. PATENT DOCUMENTS 2,945,445 A * 7/1960 Smith ..... F04D 15/0072 137/565.33
3,385,217 A 5/1968 Bles
(Continued)

FOREIGN PATENT DOCUMENTS

CN 101858346 A 10/2010
CN 201763599 U 3/2011
(Continued)

OTHER PUBLICATIONS

CN101858346A_EnglishTranslation.
(Continued)

*Primary Examiner* — Essama Omgba
*Assistant Examiner* — Philip Stimpert
(74) *Attorney, Agent, or Firm* — Zarley Law Firm, P.L.C.

(57) ABSTRACT

A selective flow hydraulic gear pump has an integral unit with a front pump section and a rear pump section. The front pump section has a pumping gear set, gear plate, and bearing plate housing. The rear pump section has a pumping gear set, gear plate, and cover housing. The integral unit has an inlet port common to both the bearing plate housing and the cover housing. Check valves and solenoid operated control valves are contained within the bearing plate housing and the cover housing and are associated with a first fluid conduit. A second fluid conduit is in communication with and extends between the bearing plate housing an outlet port in the cover housing.

14 Claims, 3 Drawing Sheets

(51) Int. Cl.

| | |
|---|---|
| ***F04C 14/02*** | (2006.01) |
| ***F04C 14/24*** | (2006.01) |
| *F04B 49/03* | (2006.01) |
| *F04C 15/00* | (2006.01) |
| *F04C 15/06* | (2006.01) |

(52) U.S. Cl.
CPC ..... *F04B 49/03* (2013.01); *F04C 15/0057* (2013.01); *F04C 15/06* (2013.01)

(58) Field of Classification Search
CPC ..... F04C 15/0057; F04C 14/10; F04B 23/04; F04B 23/08; F04B 23/06; F04B 23/10; F04B 23/103; F04B 23/106; F04B 23/12; F04B 23/14; F04B 49/03; F04B 49/035
USPC ..... 417/288, 428, 310
See application file for complete search history.

(56) References Cited

U.S. PATENT DOCUMENTS 3,996,841 A 12/1976 Gostomski, Jr.
5,228,289 A * 7/1993 Norton ..... B60T 13/16 303/10
5,842,837 A * 12/1998 Nakayoshi ..... F04C 15/062 417/286
6,932,583 B2 * 8/2005 Niethammer ..... F02M 59/08 123/446
2007/0111855 A1 5/2007 Voigt
2010/0054963 A1 * 3/2010 Yokoi ..... F04C 11/001 417/310
2012/0036992 A1 * 2/2012 Friedrich ..... F04B 23/06 91/418

FOREIGN PATENT DOCUMENTS

CN 102364105 A 2/2012
CN 202203110 U 4/2012
EP 0811765 A3 5/1996

OTHER PUBLICATIONS

CN201763599U_EnglishTranslation.
CN102364105A_EnglishTranslation.
Chinese Office Action and Search Report issued by the State Intellectual Property Office (SIPO) dated Feb. 24, 2017; Chinese Patent Application No. 201410138238.0; Danfoss Power Solutions Inc.
Chinese Office Action and Search Report issued by the State Intellectual Property Office (SIPO) dated Feb. 24, 2017; Chinese Patent Application No. 201410138238.0; Danfoss Power Solutions Inc.—English translation.

* cited by examiner

SELECTABLE FLOW HYDRAULIC GEAR PUMP

CROSS REFERENCE TO RELATED APPLICATION

This application claims the benefit of U.S. Provisional Application No. 61/809,663 filed Apr. 8, 2013.

BACKGROUND OF THE INVENTION

This invention is directed to a multiple section hydraulic gear pump, and more particularly to a hydraulic gear pump capable of providing up to four different flow rates.

There exists a need in the art for a hydraulic pump that has multiple output flows to accommodate various machine functions that are combined with finite machine elements. There also is a need for a pump that minimizes engine HP requirements during all phases of machine operation. Finally, there is a need for a pump that is adjustable to allow reduced starting torsional loads during extreme cold engine start conditions.

Therefore, an objective of the present invention is to provide a hydraulic pump that is easily adjustable to provide multiple output flows during all phases of machine operation.

These and other objectives will be apparent to one of ordinary skill in the art based upon the following written description, drawings and claims.

SUMMARY OF THE INVENTION

A selective flow hydraulic gear pump has an integral unit with a front pump section and a rear pump section. The front pump section has a pumping gear set contained within a gear plate associated with, and adjacent to a bearing plate housing. The rear pump section has a pumping gear set contained within a gear plate associated with, and adjacent to a cover housing.

The integral unit has an inlet port common to both the bearing plate housing and the cover housing. Check valves and solenoid operated control valves are contained within the bearing plate housing and the cover housing and are associated with a first fluid conduit. A second fluid conduit is in communication with and extends between the bearing plate housing and an outlet port for the cover housing.

DETAILED DESCRIPTION OF THE PREFERRED EMBODIMENTS

Figure 1:
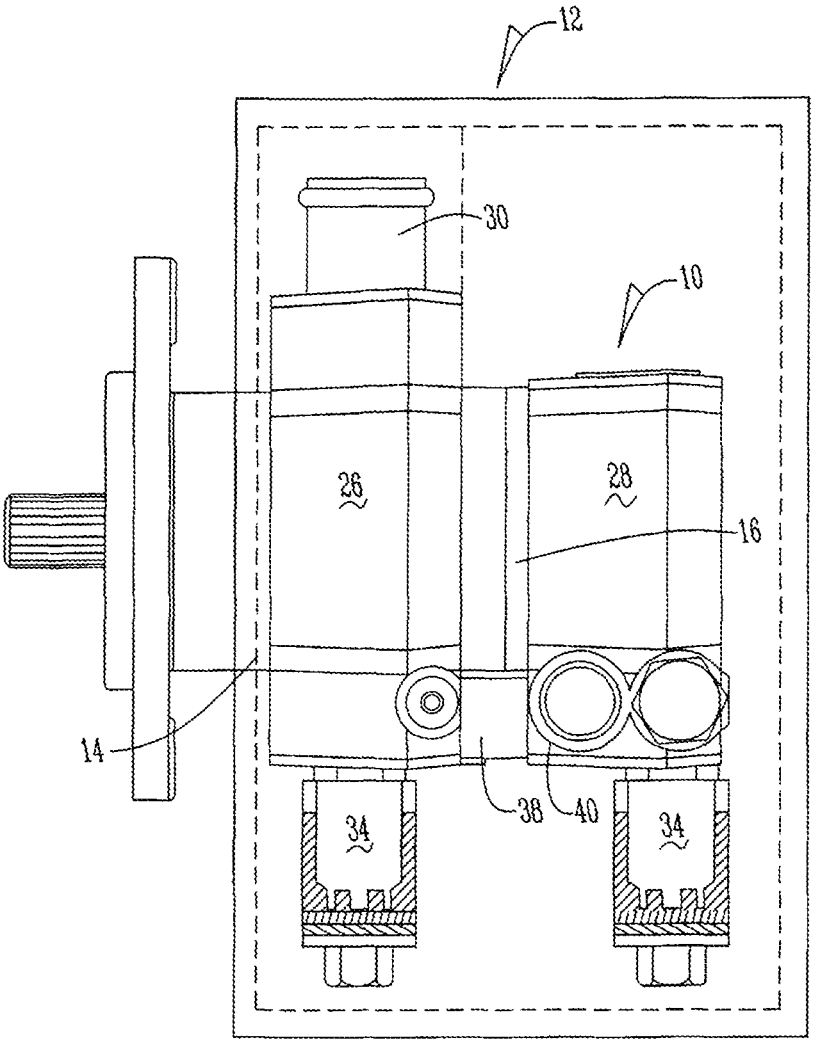
FIG. 1 is a side view of a selective flow hydraulic pump.
Figure 2:
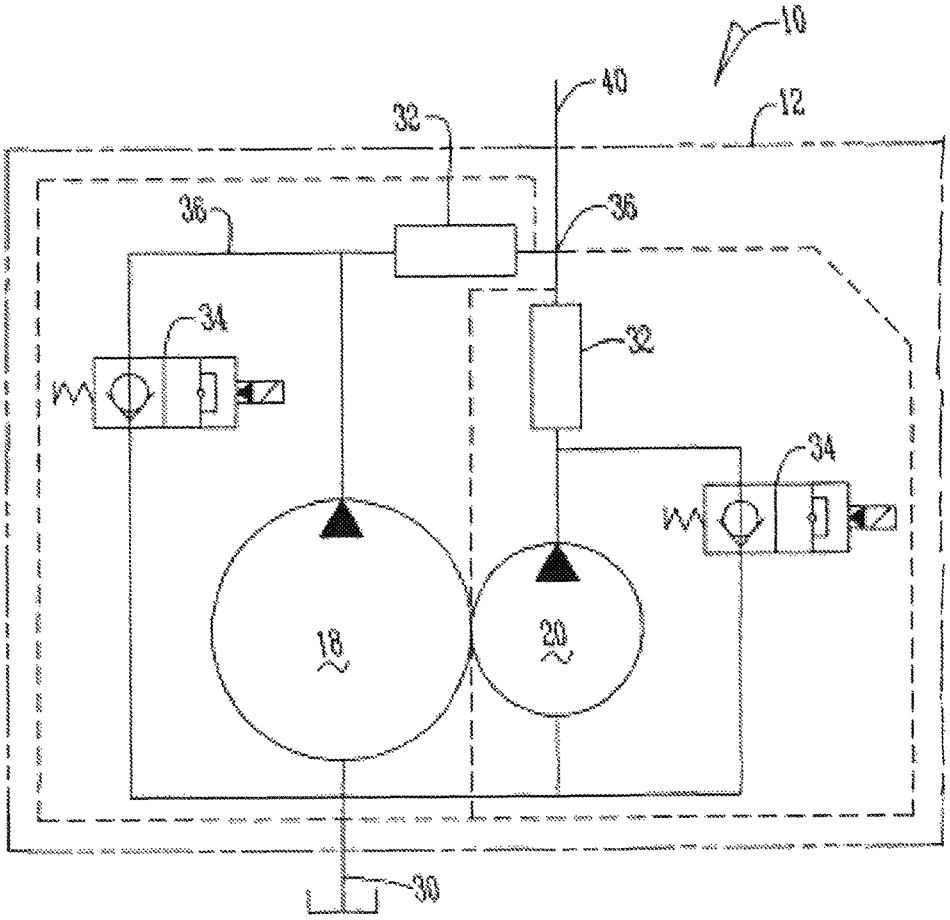
FIG. 2 is a schematic view of a selective flow hydraulic pump.
Figure 3:
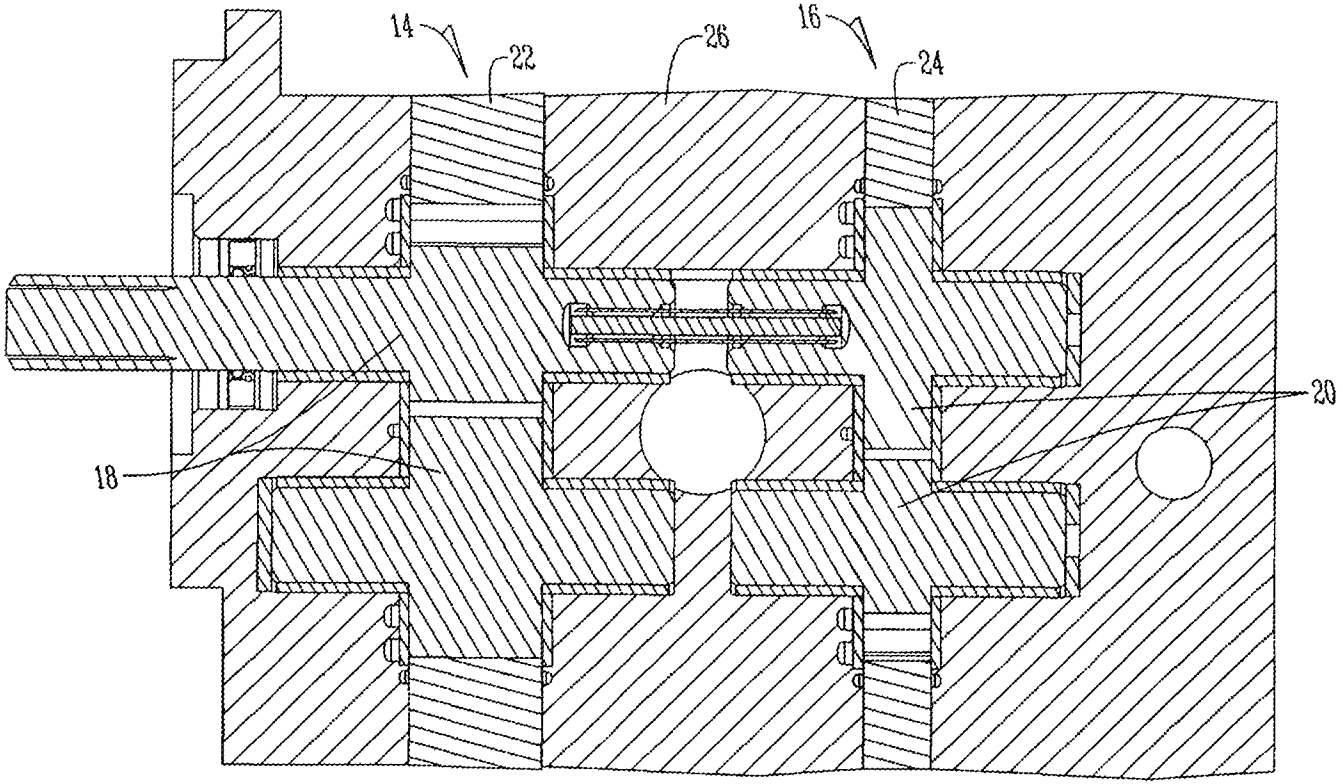
FIG. 3 is a side view of a cross section of a selective flow hydraulic pump.

Referring to the Figures, a hydraulic gear pump 10 has, within a total number of pumping sections, an integral unit 12 having a pair of pumping gear sets 14 and 16 consisting of gears 18 and 20 contained within gear plates 22 and 24. The gear sets 14 and 16 are of any displacement available, but will necessarily be of differing displacements to allow medium and low pump flow options, and have a bearing plate housing 26 that separates the gear sets 14 and 16 of the integral unit 12 into a front, or first gear set 14, and a second or rear gear set 16. Gear sets 14 and 16 may be positioned such that gear set 14 is in the front pumping section and gear set 16 is in the rear pumping section, or the great set 16 is in the front pumping section and gear set 14 is in the rear pumping section. For illustrative purposes, however, gear set 14 will be shown as the larger gear set and gear set 16 will be shown as the smaller gear set.

Referring to the integral unit 12 without regard to other pump sections that may exist within the hydraulic gear pump 10, either the bearing plate housing 26, the cover housing 28, or both have an inlet port 30 common to both the front 14 and rear 16 pump sections. Both the bearing plate housing 26 and cover housing 28 have a check valve 32 and a solenoid operated control valve 34 associated with a fluid conduit 36. The check valves 32 and solenoid operated control valve 34 are of any size, shape, and type. The check valve 32 in the bearing plate housing 26 prevents flow from the rear pump section 16 to the front pump section 14. The check valve 32 in the cover housing 28 prevents flow from the front pump section 14 to the rear pump section 16.

External to the gear sets 14 and 16 is a passage or conduit 38 that is in communication with and extends from the front pump section 14 bearing plate housing 26 to a hydraulic outlet port 40 in the cover housing 28.

In operation, to generate high flow, both solenoid operated control valves 34 are caused to close which causes output flows from the front pump section 14 and the rear pump section 16 to combine at the hydraulic outlet port 40.

To generate a medium flow, with the larger displacement gear set 14 in the rear, the solenoid valve 34 in the bearing plate housing 26 is caused to open so that the flow of the smaller front pump section 16 is rerouted back to the pump inlet 30 at low pressure while flow from the rear pump section 14 is routed to the outlet port 40.

To generate medium flow, with the larger displacement gear set 14 in the front, the solenoid valve 34 in the cover housing 28 is caused to open so that the flow in the smaller rear pump section 16 is rerouted back to the pump inlet 30 at low pressure while flow from the front pump section 14 is routed to the outlet port 40.

To generate low flow, with the larger displacement gear set 14 in the rear, the solenoid valve 34 in the bearing plate housing 26 is caused to close while the solenoid valve 34 in the rear pump section cover housing 28 is opened. As a result, flow from the rear pump section 14 is re-routed back to the pump inlet 30 and flow from the smaller front pump section 16 is routed to the outlet port 40.

To generate low flow, with the larger displacement gear set 14 in the front, the solenoid valve 34 in the bearing plate housing 26 is caused to open while the solenoid valve 34 in the rear pump section cover housing 28 is closed. As a result, flow from the front pump section 14 is re-routed back to the pump inlet 30 and flow from the smaller rear pump section 16 is routed to the outlet port 40.

Finally, to generate zero flow, both solenoid valves 34 are caused to be opened such that flows from both the front pump section 36 and the rear pump section 34 are rerouted to pump inlet 30 and no flow is routed to the outlet port 40.

Thus, a selectable flow hydraulic pump has been disclosed that at the very least meets all the stated objectives.

What is claimed is:

1. A hydraulic gear pump, comprising:

an integral unit having a front pump section with a first pumping gear set located within a bearing plate housing and a rear pump section with a second pumping gear set located within a cover housing;

wherein the first and second pumping gear sets have differing displacements;

an inlet port common to both the front and rear pump sections;

a first check valve and a first solenoid operated control valve in the bearing plate housing and a second check valve and a second solenoid operated control valve in the cover housing wherein the first check valve, the first solenoid operated control valve, second check valve, and second solenoid operated control valve are associated with a first fluid conduit;

a second fluid conduit that is in communication with and extends from the bearing plate housing to an outlet port in the cover housing; and wherein the first and second solenoid valves are configured to selectively and independently activate to provide a first, a second, a third, and a fourth flow level.

2. The pump of claim 1 wherein the second fluid conduit is external to the gear sets.

3. The pump of claim 1 wherein the first and second solenoid operated control valves are closed causing output flows from the front pump section and the rear pump section to combine at the outlet port.

4. The pump of claim 1 wherein the first solenoid operated control valve in the bearing plate housing is open such that flow from the front pump section is routed to the inlet port while flow from the rear pump section is routed to the outlet port.

5. The pump of claim 1 wherein the first solenoid operated control valve in the bearing plate housing is closed while the second solenoid operated control valve in the cover housing is opened such that flow from the rear pump section is routed to the inlet port and flow from the front pump section is routed to the outlet port.

6. The pump of claim 1 wherein the first and second solenoid operated control valves are opened such that flow from both the front and rear pump sections are routed to the inlet port and no flow is routed to the outlet port.

7. The pump of claim 1 wherein the second solenoid operated control valve in the cover housing is opened such that flow from the rear pump section is routed to the pump inlet and flow from the front pump section is routed to the outlet port.

8. The pump of claim 1 wherein the first solenoid operated control valve in the bearing plate housing is opened and the second solenoid operated control valve in the cover plate housing is closed such that the flow from the front pump section is routed to the pump inlet and flow from the rear pup section is routed to the outlet port.

9. A hydraulic gear pump, comprising:

an integral unit having a rear pump section with a first pumping gear set and a front pump section with a second pumping gear set;

wherein the first pumping gear set has a larger displacement than the second pumping gear set;

an inlet port common to both the front and rear pump sections;

a first check valve and a first solenoid operated control valve in the rear pump section and a second check valve and a second solenoid operated control valve in the front pump section wherein the first check valve, the first solenoid operated control valve, second check valve, and second solenoid operated control valve are associated with a first fluid conduit;

a second fluid conduit that is in communication with and extends from the integral unit to an outlet port in the cover housing;

wherein when the first solenoid valve is caused to close and the second solenoid valve to open simultaneously, the flow in the first pumping gear set flows to the outlet port and the flow in the second pumping gear set flows to the inlet port; and wherein when the first solenoid valve is caused to open and the second solenoid valve to close simultaneously, the flow in the first pumping gear set flows to the inlet port and the flow in the second pumping gear set flows to the outlet port.

10. The pump of claim 9 wherein when the first solenoid valve and the second solenoid valve are caused to close, the flow in the first pumping gear set and the second pumping gear set flows to the outlet port.

11. The pump of claim 9 wherein when the first solenoid valve and the second solenoid valve are caused to open, the flow in the first pumping gear set and the second pumping gear set flows to the inlet port.

12. A hydraulic gear pump, comprising:

an integral unit having a front pump section with a first pumping gear set and a rear pump section with a second pumping gear set;

wherein the first pumping gear set has a larger displacement than the second pumping gear set;

an inlet port common to both the front and rear pump sections;

a first check valve and a first solenoid operated control valve in the front pump section and a second check valve and a second solenoid operated control valve in the rear pump section wherein the first check valve, the first solenoid operated control valve, second check valve, and second solenoid operated control valve are associated with a first fluid conduit;

a second fluid conduit that is in communication with and extends from the integral unit to an outlet port in the cover housing;

wherein when the first solenoid valve is caused to close and the second solenoid valve to open simultaneously, the flow in the first pumping gear set flows to route to the outlet port and the flow in the second pumping gear set flows to route to the inlet port; and wherein when the first solenoid valve is caused to open and the second solenoid valve to close simultaneously, the flow in the first pumping gear set flows to the inlet port and the flow in the second pumping gear set flows to the outlet port.

13. The pump of claim 12 wherein when the first solenoid valve and the second solenoid valve are caused to close, the flow in the first pumping gear set and the second pumping gear set flows to the outlet port.

14. The pump of claim 12 wherein when the first solenoid valve and the second solenoid valve are caused to open, the flow in the first pumping gear set and the second pumping gear set flows to the inlet port.

* * * * *